United States Patent [19]

Glaesener

[11] 4,307,973

[45] Dec. 29, 1981

[54] ROAD BARRIER

[75] Inventor: Ernest Glaesener, Luxembourg, Luxembourg

[73] Assignee: Arbed S.A., Luxembourg, Luxembourg

[21] Appl. No.: 114,287

[22] Filed: Jan. 22, 1980

[30] Foreign Application Priority Data

Jan. 23, 1979 [LU] Luxembourg ..... 80813

[51] Int. Cl.[3] ..... E01F 15/00

[52] U.S. Cl. ..... 404/6; 256/13.1

[58] Field of Search ..... 404/6, 7, 8, 9; 256/13.1

[56] References Cited

U.S. PATENT DOCUMENTS

| | | | |
|---|---|---|---|
| 3,288,440 | 11/1966 | Schimmelpenninck et al. | 404/6 X |
| 3,308,724 | 3/1967 | Smith | 404/7 |
| 3,326,099 | 6/1967 | Cova et al. | 404/7 |
| 3,353,795 | 11/1967 | Muller | 256/13.1 |
| 3,603,562 | 9/1971 | Glaesener | 256/13.1 |
| 3,704,861 | 12/1972 | Glaesener | 256/13.1 |
| 3,784,167 | 1/1974 | Glaesener | 256/13.1 |
| 3,963,218 | 6/1976 | Glaesener | 404/6 X |
| 4,075,473 | 2/1978 | Winston | 404/6 X |

FOREIGN PATENT DOCUMENTS

| | | | |
|---|---|---|---|
| 2026225 | 3/1972 | Fed. Rep. of Germany . | |
| 2141369 | 3/1973 | Fed. Rep. of Germany | 256/13.1 |
| 2547543 | 4/1976 | Fed. Rep. of Germany | 256/13.1 |
| 2552676 | 6/1976 | Fed. Rep. of Germany | 256/13.1 |
| 390977 | 8/1965 | Switzerland | 256/13.1 |
| 1209191 | 10/1970 | United Kingdom | 256/13.1 |

*Primary Examiner*—Rodney H. Bonck
*Attorney, Agent, or Firm*—Karl F. Ross

[57] ABSTRACT

A road barrier for traffic lanes, raceways and the like comprises a sheet-metal shell which is internally galvanized and is filled with a synthetic-resin foam and which extends continuously along the lane in contact with the ground while being of a height equal at least to a substantial fraction of the average wheel height for four-wheel and two-wheel vehicles using the traffic lane. The structure is anchored to the ground by posts fitting into openings in the rail and in the ground and likewise formed of sheet metal.

10 Claims, 7 Drawing Figures

ROAD BARRIER

CROSS REFERENCE TO RELATED APPLICATION

This application is related to the commonly assigned copending application Ser. No. 114,330.

FIELD OF THE INVENTION

The present invention relates to a road barrier and, more particularly, to a lane-lining device which is intended to maintain both two-wheel and four-wheel vehicles in their proper travel paths for highways, streets, roads and raceways.

BACKGROUND OF THE INVENTION

Originally roads, whether paved or unpaved, had illdefined travel paths or lanes so that oppositely traveling vehicles could readily encounter one another or leave the sides of the road.

A certain measure of protection to vehicle drivers and their passengers was afforded by providing a median strip of raised construction between oppositely traveled lanes and/or by providing the sides of the road with a curb or raised portion.

In some cases, the raised portions, intended to guide the vehicle wheels back into the proper travel lane, were prismatic humps, ribs or ridges of concrete anchored to the ground or to the pavement. For the most part, these structures had a height significantly less than half the diameter of the average wheel used by vehicles traveling on the roadway.

Attempts were made to improve upon such structures because, while the concrete ridges had relatively low repair cost and were easily fabricated and mounted, especially during road building operations, they had disadvantages. For example, when the guide ridge was relatively low, the wheel of a wayward vehicle could readily jump the ridge and hence the guiding function was lost or inadequate.

Naturally, attempts were made to utilize prismatic concrete structures of somewhat greater height. With such systems the vehicles did not as readily jump the guide member, but any encounter of the vehicle with the concrete structure could cause considerable damage to the vehicle and to the operator or passenger.

This is a particular disadvantage in the case of roadways traveled by motorcycles and like two-wheel vehicles since any encounter of the vehicle with a concrete barrier of this type almost of necessity will result in an impact between the vehicle user and the structure at an elevated speed with serious injury to the person. It will be readily recognized that any impact between an individual moving at any substantial speed if carried by or thrown from the vehicle, with an immovable concrete object cannot fail to cause significant injury, if not death.

Still another disadvantage of rigid or nonyieldable concrete road barriers is that the significant friction between the wheel and concrete can result in a climbing of the wheel upon the barrier if the angle of attack of the wheel is appropriate, such that the vehicle may leap the barrier or may be overturned by the encounter with obvious drawbacks both for four-wheel and two-wheel vehicles.

Other types of barriers have been described by my previous applications and reference can be made, for example, to my U.S. Pat. Nos. 3,322,390; 3,476,549; 3,603,562; 3,704,061; 3,784,167; 3,963,218; 3,881,697; 3,966,173 and 4,047,701, and in the documents or references cited or made of record therein.

Particular attention is directed to the system of German Pat. No. 20 26 225 which, like some of the United States patents mentioned, describes a road barrier in which the guide planks are spaced above the ground or road surface on posts which are longitudinally separated along the direction of travel, the barrier or plank being formed as a hollow sheet-metal profile filled with a synthetic-resin foam. An advantage of this type of road barrier is that the plank is both flexible and stable, operating without a significant rebound tendency so that a slingshot return of the vehicle into the travel lane is avoided while the kinetic energy is dissipated as the vehicle slides along the yieldable length of the rail.

Because of the yieldability of these rails, the likelihood of damage to the vehicle and even to operating personnel or passengers is seriously diminished by comparison with rigid concrete structures.

Nevertheless, since rigid posts were generally provided at spaced apart locations along such a rail, to support it above the ground, there was always the danger that the impact of an operator or a passenger with the rail could cause some injury analogous to that which occurs upon an encounter with a concrete structure.

A further disadvantage of earlier types of flexible-rail systems is the unesthetic appearance of them and the fact that especially at night the posts, and spaces between the posts, cooperate with the headlights of the vehicles to disturb the concentration of the driver. An object of this invention is to overcome these disadvantages.

OBJECTS OF THE INVENTION

This object and others which will become apparent herein are attained, in accordance with the present invention, in a road barrier which comprises an upright shell or profile of sheet metal, enclosed at least on three sides and filled with a synthetic resin foam which can be formed in situ in the interior of the shell, the shell being of varying width over its height and preferably of a progressively increasing width from the bottom to the top, and means for mounting this rail structure so that its lower edge lies against the ground.

The latter means preferably are posts which are spaced apart along the length of the rail and are received in sockets or openings formed in both the ground and in the profiles.

According to a feature of the invention, the height of the rail is greater than the diameter of the average wheel of a vehicle traveling along the roadway, e.g. approximately a meter, so that both ordinary passenger cars and two-wheel vehicles likely to travel on the roadway have wheels whose diameters are considerably less than the height of the rail.

According to another feature of the invention, the sheet metal is steel sheet of the thickness of the steel of the U.S. patents mentioned while the foamed synthetic resin is of the composition and density there set forth, the interior of the shell or hollow profile being hot galvanized before foaming synthetic resin therein.

According to a further feature of the invention, the successive hollow-profile or rail sections are stepped at one end by about the thickness of the metal for insertion into the opposite end of a corresponding rail or section so that the sections or lengths can be continuously interconnected end-to-end. The connection is fixed by transverse rivets, bolts or like members, or is retained by an adhesive.

According to the present invention, the posts are entirely housed in the hollow-profile or shell rail and in the ground so that exposed portions of the posts or other supports are eliminated. Thus there are no exposed edges which can endanger the vehicle or the riders.

Since the walls of the rail can be free from discontinuities and are composed of metal, the friction with which the wheel engages the rail is small and any tendency for the wheel to climb the rail is likewise reduced.

Each length of the hollow profile or shell can be composed of one or two sheet metal strips, again ensuring a minimum number of edges, seams or the like which can endanger the person or the vehicle.

According to a feature of the invention, one side of the rail can be open. Preferably this side is the bottom which is turned toward the ground. This simplifies the connection of successive lengths, since a connection between sheet metal elements along the bottom is difficult to achieve.

When, however, an open-side hollow profile or shell is not desirable, the side through which the synthetic resin is introduced can be closed by a sheet metal strip or by flanges of the strip or strips forming the side walls of the shell and which can be interconnected by a channel, by a bracket, by interconnected bends or by a separate member.

It has already been indicated that the preferred configuration of the shell has a progressively increasing width in this upward direction. This can be attained by forming the rail as a downwardly converging trapezoid, in cross section, or, as is preferred, of the cross section of a generally mushroom shape.

Either configuration, in which the upper portion is wider than the lower portion, ensures that an engagement of the wheel with the rail will result predominantly in a downward force component thereby preventing the wheel from riding up and retaining contact between the wheel and the road surface. A similar effect results from contact of the vehicle body or the fenders with a portion of the rail below the top.

The mushroom-shaped cross section has been found to be particularly effective in preventing the vehicle or a rider from being thrown into the oncoming traffic lane.

In fact the mushroom-shaped cross section has been found to be particularly advantageous not only for four-wheel vehicles, such as automobiles, but is even more effective for two-wheel vehicles such as motorcycles since the rail tends to hold contact with the wheel of the vehicle as it slides along the rail to dissipate its kinetic energy. This is particularly true along curves which tend to swing the vehicle outwardly. Hence the barrier has been found to be highly effective along the traveled lanes of racetracks and the like.

When the barrier has the configuration of a downwardly converging or inverted trapezoid, the flanks should include angles with the vertical of at most 30° and all upper edges should be rounded.

According to yet another feature of the invention, the flanks turned toward the travel lane or lanes of the barrier can be corrugated with the corrugations extending in the direction of vehicle travel.

The corrugations both stiffen the barrier without materially reducing its elasticity and provide additional insurance against the upward movement of the wheel in contact with the rail. The shell can be provided with internal stiffening with the stiffeners being throughgoing or located at spaced apart points and formed by the posts or other members. Furthermore, the posts are preferably hollow bodies of, for example, rectangular profile and formed from sheet metal with or without the synthetic resin foam filling. To accommodate the posts, complementary-shaped sockets or recesses can be provided in the rail and in the ground. When the posts are of two-part construction, one part can be inserted in the ground and the other into the rail, the two being interfitted. Three-part posts can also be used in which case identical socket-shaped parts can be inserted in the rail and the ground and can be bridged by an intermediate or third part fitting into the first two and having a central bead between them.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
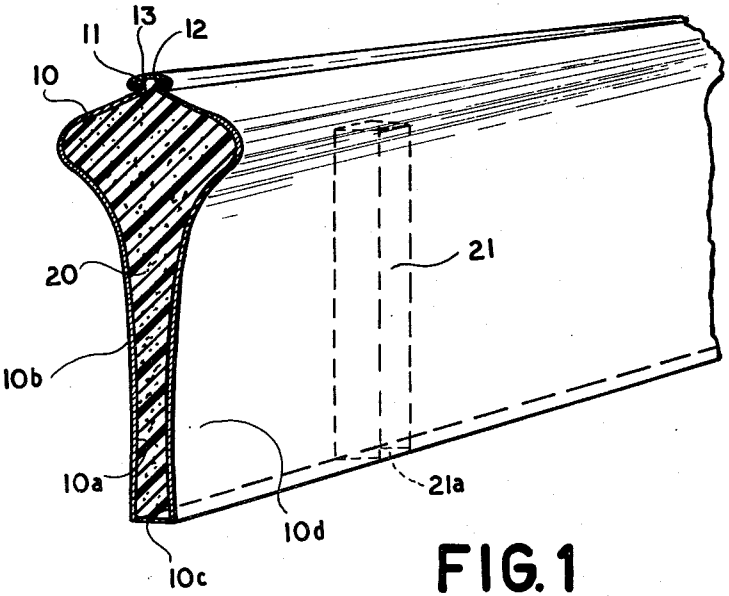
FIG. 1 is a perspective view, seen in section at an end thereof, of a barrier rail provided with a mushroom-shaped cross section according to the invention.

As can be seen from FIG. 1, a rail for use as a road barrier according to the invention comprises a hollow-profile shell 10 of sheet metal which is hot galvanized on its inner surface 10*a* and which encloses a foam synthetic resin filling 20 on at least three sides 10*b*, 10*c* and 10*d*, the sides 10*b* and 10*d* constituting the flanks of the rail. The upper edges of the shell are flanged at 11 and 12 to form grooves in which a sheet metal channel 13 has its edges received so that the two flanks are connected together. The rail has a mushroom-shaped cross section which progressively widens upwardly and has a recess 21 left in the foam filling and open at 21*a* to accommodate the upper portion of a post 40, for example, or one of the posts shown in FIGS. 6 and 7. The shell may be externally galvanized as well and can be painted with reflective paint.

Figure 2:
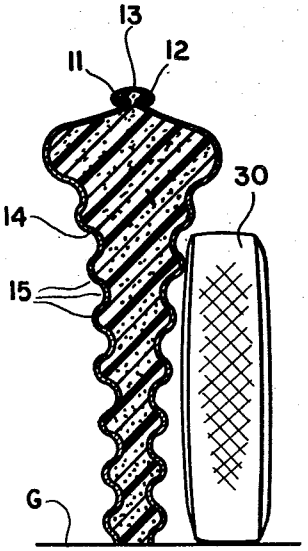
FIG. 2 is a section through another rail with a generally mushroom-shaped cross section.

In use the shell is adapted to rest upon the ground G as shown in FIG. 2 and the flanks can be corrugated as shown for the flanks 14 by the longitudinally extending configurations 15. A wheel 30, engaging at an upper portion with one of the flanks 14 is thus given a downward force component because of the overhanging nature of the barrier. From FIG. 3, it will be apparent that the rail can also have the configuration of a downwardly converging trapezoid whose small base 16 may be open. Here the rail 110 has lateral flanks 110*b* and 110*d* which also can be corrugated and which includes angle $\alpha$ with the vertical of up to 30°. The foam synthetic resin filling is shown at 120 and it is also apparent from FIG. 3 that the reinforcements 22 can be provided in the rail to stiffen the latter, the reinforcements 22 extending longitudinally.

Figure 3:
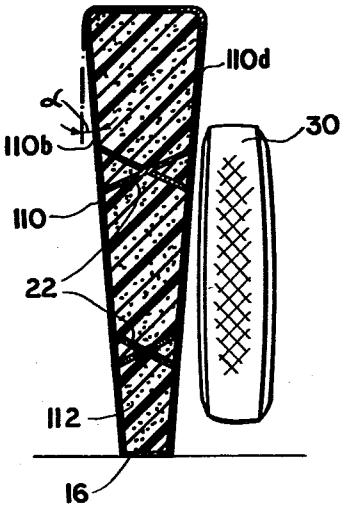
FIG. 3 is a view of still another rail according to the invention with an inverted trapezoidal cross section.

When the rails are mounted as shown in FIGS. 1 through 3, the openings 21 therein can receive the upper portion of the post 40 while the entire lower portion can be recessed in a complementary socket formed in the ground.

Figure 6:
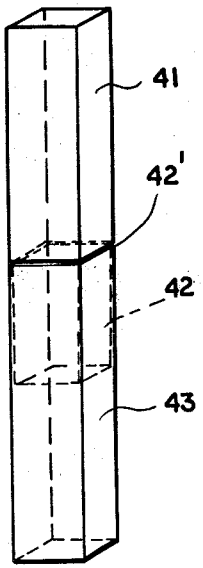
Figure 5:
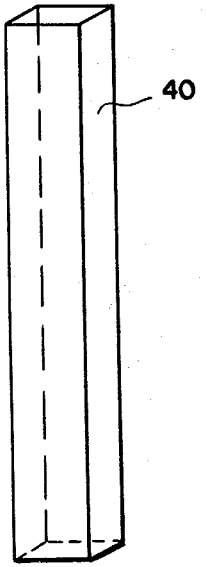

A two-part post has been shown in FIG. 6 and consists of an upper part 41 which is received in the rail but has a tongue 42 fitting into the lower part 43 which is recessed flush in the ground so that the edge 42' lies at ground level.

Figure 7:
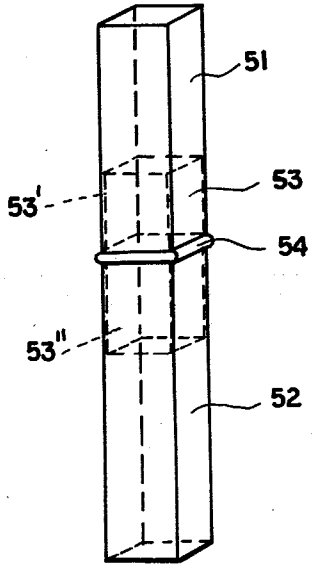
FIGS. 5, 6 and 7 are respective perspective views of post constructions for use in the present invention.

A three-part post has been illustrated in FIG. 7 with identical upper and lower parts 51 and 52 recessed in the rail and in the ground and receiving the tongues 53' and 53'' of an intermediate part 53 having a central bead 54 lying at the ground level and provided with an intentional break zone, e.g. by weakening the central part in a manner not further illustrated.

Figure 4:
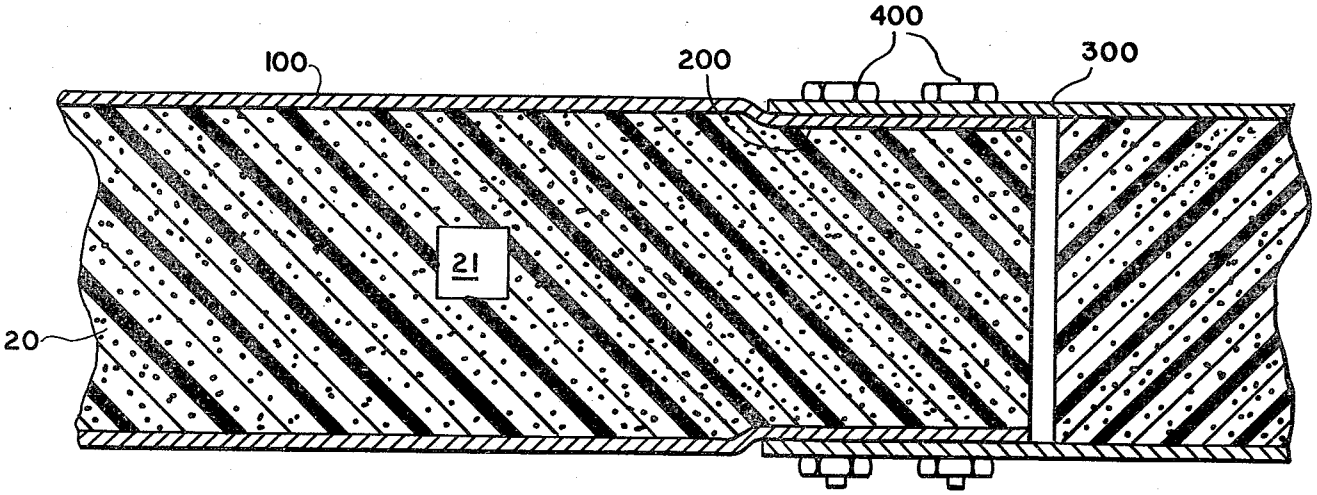
FIG. 4 is a cross-sectional view illustrating the connection of successive lengths of a rail according to the invention.

From FIG. 4 is will be apparent that the end on the rail section 10 can be stepped at 200 by approximately the thickness of the sheet metal shell so as to be received in the opposite end of a corresponding rail section 300, the connection being made by transverse bolts, one of which has been shown at 400.

I claim:

1. A safety barrier for a vehicle traffic lane comprising a rail adjacent said lane and extending longitudinally therealong, said rail being formed with a sheet metal shell defining at least three sides of the rail including a top and a pair of lateral sides, said shell having a downwardly narrowing cross section so that an upper portion of said shell is wider than the bottom of said shell, the wider upper portion of said shell being spaced above said bottom of said shell by a distance generally greater than the maximum diameter of a wheel of a vehicle authorized to travel along said lane and the diameter of the wheels of normal traffic along said lane, said bottom of said shell lying against the ground along a lower edge of the rail, a plurality of completely concealed posts spaced apart along said rail, each of said posts having an upper portion completely received in said shell and extending upwardly into said shell from said bottom thereof, and a lower portion recessed in the ground, said rail further comprising a mass of synthetic resin foam filling said shell and completely surrounding said upper portions of said posts while defining spaces receiving said upper portions of said posts.

2. The safety barrier defined in claim 1 wherein said bottom of said shell is open toward the ground.

3. The safety barrier defined in claim 2 wherein said shell is formed from a pair of flank pieces of sheet metal having flanged upper edges and a connecting strip bridging said edges and closing said shell at the top thereof.

4. The safety barrier defined in claim 2 wherein said shell has an upright generally mushroom-shaped cross section.

5. The safety barrier defined in claim 2 wherein said shell has the cross section of a trapezoid with downwardly converging flanks including angles with the vertical of utmost 30°.

6. The safety barrier defined in claim 4 or claim 5 wherein said sides are corrugated flanks with the corrugations extending longitudinally along the rail.

7. The safety barrier defined in claim 4 or claim 5, further comprising stiffeners bridging said sides and embedded in said mass.

8. The safety barrier defined in claim 4 wherein each of said posts is bipartite and formed with one part recessed in said rail and a second part interfitting with said one part and recessed in the ground.

9. The safety barrier defined in claim 4 wherein each of said posts is tripartite, having a first part recessed in said rail, a second part recessed in the ground and a third part interfitting with and connecting said first and second parts and forming a peripheral bead therebetween.

10. The safety barrier defined in claim 4 wherein each of said posts is formed with an intentional-break zone substantially at the level of the ground.

* * * * *